US007014516B2

(12) United States Patent
Yang

(10) Patent No.: US 7,014,516 B2
(45) Date of Patent: Mar. 21, 2006

(54) POWER CONNECTOR WITH AN ADJUSTABLE OPENING

(75) Inventor: Ta-Jung Yang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/053,557

(22) Filed: Feb. 8, 2005

(65) Prior Publication Data

US 2005/0277336 A1 Dec. 15, 2005

(30) Foreign Application Priority Data

Jun. 10, 2004 (TW) ..... 93116704 A

(51) Int. Cl.
*H01R 13/187* (2006.01)

(52) U.S. Cl. ..... 439/845; 439/170

(58) Field of Classification Search ..... 439/842–845, 439/635–637, 707, 708, 713, 465, 687, 696, 439/170, 212

See application file for complete search history.

(56) References Cited

U.S. PATENT DOCUMENTS

| | | | | |
|---|---|---|---|---|
| 5,171,154 A * | 12/1992 | Casciotti et al. | ..... | 439/67 |
| 5,308,249 A * | 5/1994 | Renn et al. | ..... | 439/62 |
| 5,431,576 A * | 7/1995 | Matthews | ..... | 439/247 |
| 6,089,929 A * | 7/2000 | Sloey | ..... | 439/845 |
| 6,152,742 A * | 11/2000 | Cohen et al. | ..... | 439/60 |
| 6,736,647 B1 * | 5/2004 | Gillenberg | ..... | 439/65 |

* cited by examiner

*Primary Examiner*—Hae Moon Hyeon
(74) *Attorney, Agent, or Firm*—Madson & Austin

(57) ABSTRACT

A power connector to be connected with a panel-form connector is disclosed. The power connector comprises a pair of conductive devices, and each conductive device comprises a case, a metal base, and a metal conductive piece combined with the metal base and disposed into the case. The cases of the conductive devices are cooperated with each other to define an opening, and the width of the opening is adjustable by controlling the relative distance between the conductive devices for receiving various panel-form connectors with different thicknesses.

20 Claims, 9 Drawing Sheets

POWER CONNECTOR WITH AN ADJUSTABLE OPENING

FIELD OF THE INVENTION

The present invention relates to a connector, and more particularly to a power connector.

BACKGROUND OF THE INVENTION

Power connectors have been used extensively as connective interfaces in various power delivery systems, such as a power distribution system or a power supply system. The power delivery system usually includes a cabinet, and the cabinet has a bus bar. The power connector is disposed on the bus bar for a hot-plug power supply device to be electrically connected with the power delivery system.

FIG. 1 is a schematic view showing the structure of a conventional power connector. As shown in FIG. 1, the power connector 1 includes a case 11, a conductive clip device 12, and a pair of contact plates 13. The case 11 has a top 111 and a bottom 112, wherein the top 111 has an opening 113 extending from the top 111 to the bottom 112, so as to form a receiving space (not shown). The conductive clip device 12 includes a pair of planar sides 121, 122, wherein the planar sides 121, 122 connect opposite to each other with a bending structure 123 so as to form a groove 124. The bending structure 123 of the conductive clip device 12 has a fixing portion 125 with a hole 126 to be screwed thereon. The contact plates 13 are disposed in the groove 124 of the conductive clip device 12 and fixed by engaging pieces 127 of the planar sides 121, 122. After being assembled with each other, the conductive clip device 12 and the contact plates 13 are disposed together into the receiving space of the case 11 and fixed in the case 11 by locking projections 128 of the planar sides 121, 122 propping up the inner wall of the case 11.

FIG. 2 is a schematic view showing that the power connector of FIG. 1 connects with a panel-form connector. The panel-form connector 2 is disposed on a hot-plug power supply device (not shown). The electrically conductive blade of the panel-form connector 2 has specified width, thickness, and length. The fixing portion 125 of the power connector 1 is fixed on the bus bar 3 by a screw. The length and width of the opening 113 of the power connector 1 are slightly bigger than those of the panel-form connector 2, so that the panel-form connector 2 can be inserted into the power connector 1 smoothly and contact with the contact plates 13 in the receiving space. Therefore, when the panel-form connector 2 is inserted into the power connector 1, it can be conducted with the bus bar 3 through the contact plates 13, the conductive clip device 12, and the fixing portion 125.

However, the electrically conductive blade of the panel-form connector 2 must be designed according to the specified thickness and cannot be varied with different requirements. The cooperative power connector 1 has an unadjustable opening 112, so it can only satisfy a single connection application and cannot simultaneously satisfy a single-pole and dual-pole connection applications with different thicknesses, thereby lacking a wider usability. Besides, the conventional power connector 1 also has disadvantages of large volume, complex structure, and difficult assembling.

Therefore, it is needed to provide a power connector which can overcome the aforementioned problems.

SUMMARY OF THE INVENTION

It is an object of the present invention to provide a power connector that can satisfy applications for various panel-form connectors to increase its using flexibility.

It is another object of the present invention to provide a power connector with small volume and simple structure and can be easily assembled.

In accordance with a first aspect of the present invention, a power connector used to be connected with a panel-form connector is provided. The power connector comprises a pair of conductive devices, and each conductive device comprises a case, a metal base, and a metal conductive piece combined with the metal base and disposed into the case. The cases of the conductive devices are cooperated with each other to define an opening, and the width of the opening is adjustable by controlling the relative distance between the conductive devices for receiving various panel-form connectors with different thicknesses.

In an embodiment, the pair of conductive devices have identical structure, shape and size.

Preferably, the metal base is a metal extruded base. For example, the metal extruded base is made of copper.

In an embodiment, the metal extruded base is substantially in an L shape and has a top and a bottom, the top being engaged with the metal conductive piece.

In an embodiment, the bottom of the metal extruded base has a hole, and an inner surface of the top has a concavity extending along the length direction of the metal extruded base.

In an embodiment, the case has a top and a bottom, the cross-sectional area of the bottom being bigger than that of the top.

In an embodiment, the case has two side plates respectively extending outward along two sides of the case, thereby forming a groove.

In an embodiment, a side of each side plate has a recession.

For example, the metal conductive piece is made of beryllium copper alloy.

In an embodiment, the metal conductive piece has a plurality of resilient bending elements used to contact with the panel-form connector and an engaging portion being engaged with the metal base.

In accordance with a second aspect of the present invention, a power connector disposed on a bus bar and used to be connected with a panel-form connector is provided. The power connector comprises a pair of conductive devices disposed on the bus bar, and each conductive device comprises a case, a metal base, and a metal conductive piece combined with the metal base and disposed into the case. The cases of the conductive devices are cooperated with each other to define an opening, and the width of the opening is adjustable by controlling the relative distance between the conductive devices for receiving various panel-form connectors with different thicknesses.

In an embodiment, the panel-form connector is a single-pole panel-form connector.

In accordance with a third aspect of the present invention, a power connector disposed on two bus bars and used to be connected with a panel-form connector is provided. The power connector comprises a pair of conductive devices, and each conductive device is disposed on one of the two bus bars and comprises a case, a metal base, and a metal conductive piece combined with the metal base and disposed into the case. The cases of the conductive devices are cooperated with each other to define an opening, and the width of the opening is adjustable by controlling the relative distance between the conductive devices for receiving various panel-form connectors with different thicknesses.

In an embodiment, the panel-form connector is a dual-pole panel-form connector.

In an embodiment, the dual-pole panel-form connector comprises a positive plate, a negative plate, and an isolation plate or a printed circuit board disposed between the positive plate the negative plate.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Some typical embodiments to present the features and advantages of the present invention will be precisely described in the following illustrations. It should be understood that the present invention may have various modifications in different modes, which are not apart from the scope of the present invention, and the illustrations and drawings of the present invention are substantially used for explaining but not for limiting the present invention.

Figure 1:
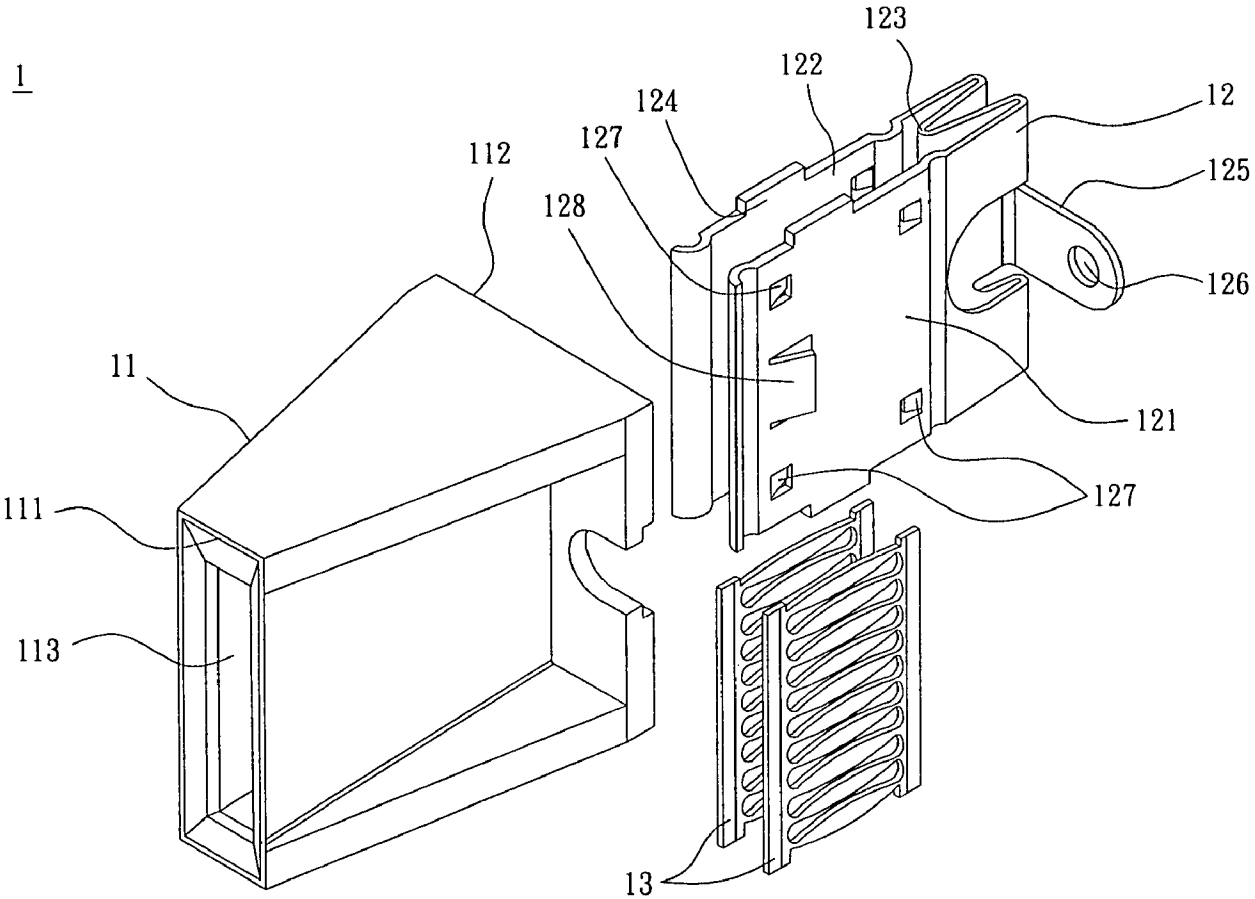
Fig. 1 (Prior Art)
FIG. 1 is a schematic view showing the structure of a conventional power connector.
Figure 2:
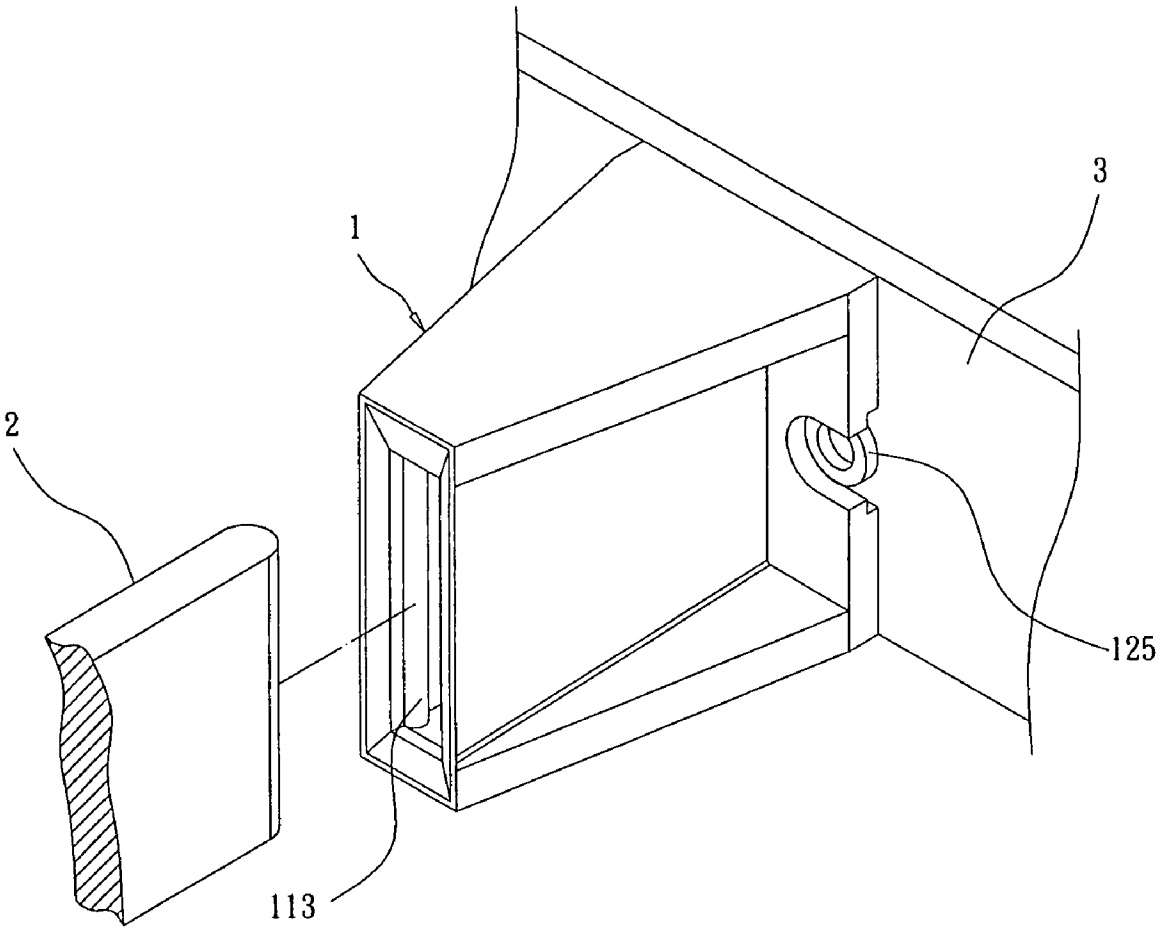
Fig. 2 (Prior Art)
FIG. 2 is a schematic view showing that the power connector of FIG. 1 connects with a panel-form connector.
Figure 3:
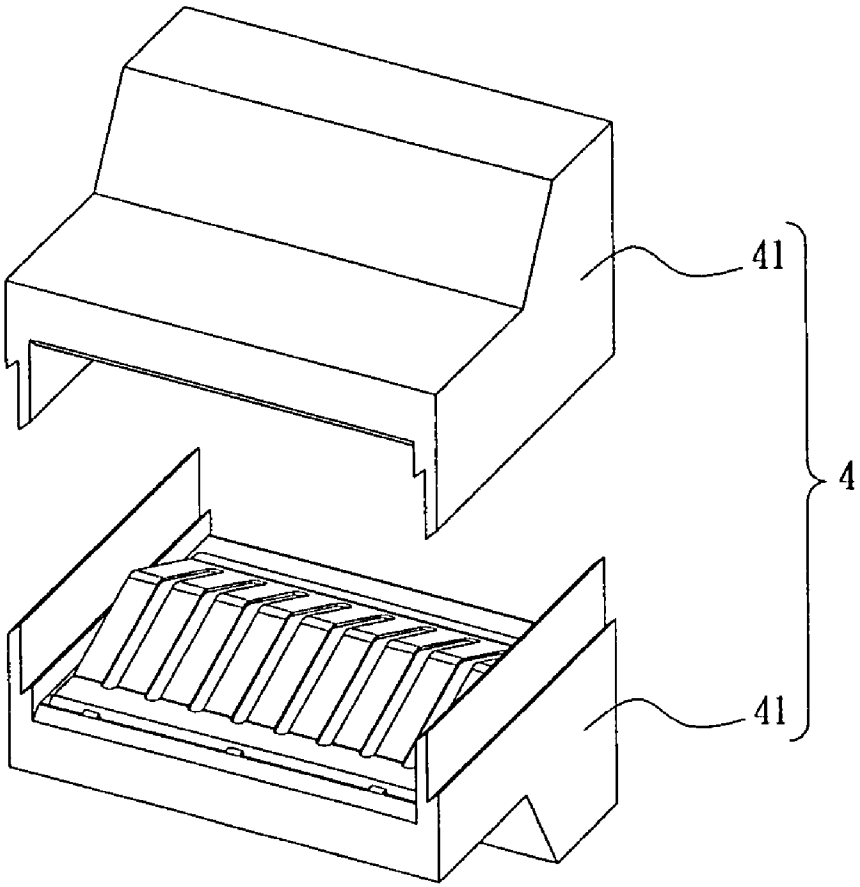
FIG. 3 is a schematic view showing the power connector according to a preferred embodiment of the present invention.

FIG. 3 is a schematic view showing the power connector according to a preferred embodiment of the present invention. As shown in FIG. 3, the power connector 4 is disposed on the bus bar (not shown) to be used as an electrically conductive interface between the panel-form connector (not shown) and the bus bar. The power connector 4 includes a pair of conductive devices 41 with identical structure, shape and size, and can be assembled with or separated from each other.

Figure 4:
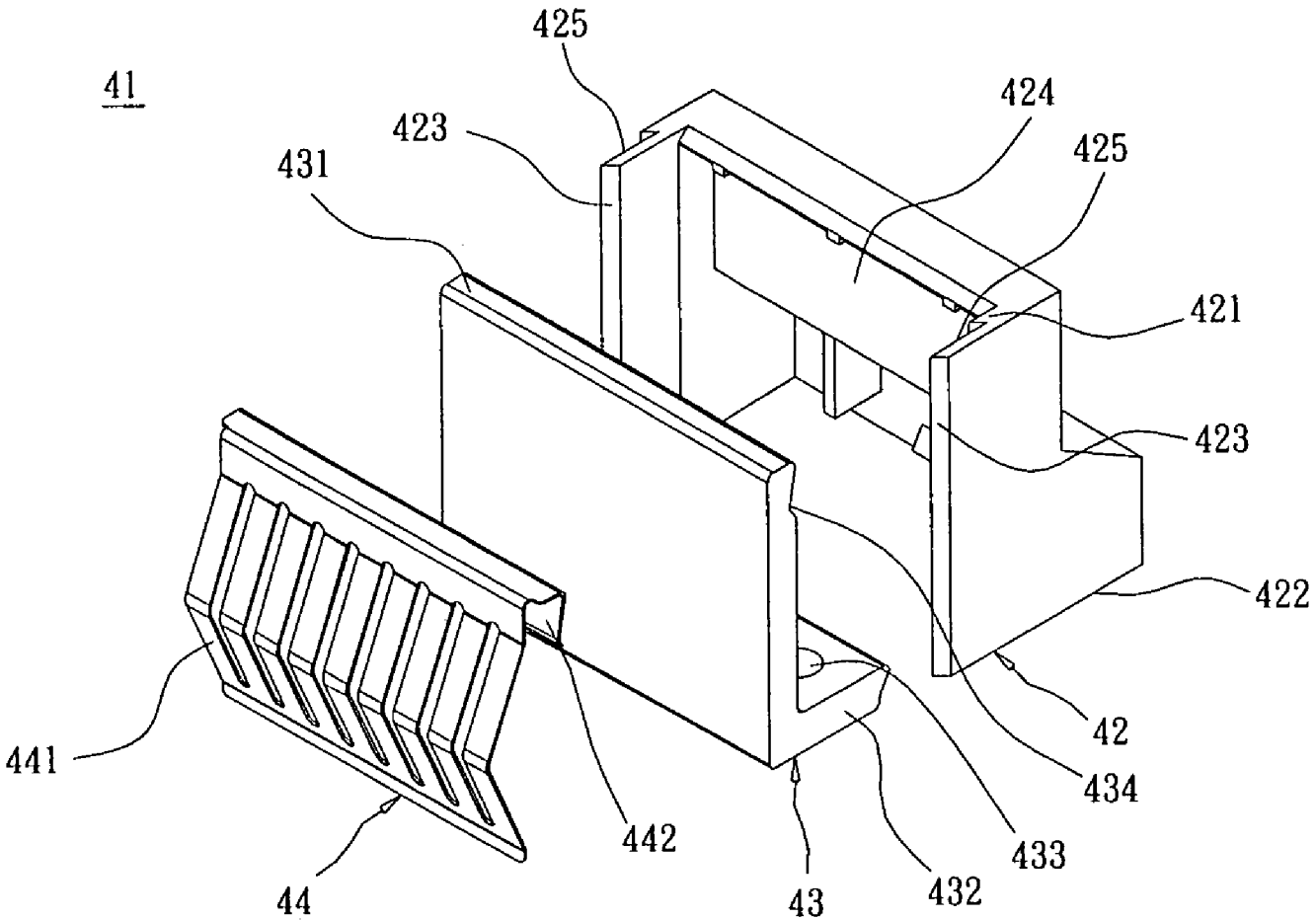
FIG. 4 is a schematic view showing the detailed structures of each conductive device in FIG. 3.

FIG. 4 is a schematic view showing the detailed structures of each conductive device. As shown in FIG. 4, the conductive device 41 includes a case 42, a metal extruded base 43, and a metal conductive piece 44. The case 42 has a top 421 and a bottom 422, wherein the cross-sectional area of the bottom 422 is bigger than that of the top 421, so that the case 42 can stand firmly. The case 42 has two side plates 423, which respectively extend outward along the two sides of the case 42, thereby forming a groove 424. Besides, a side of each side plate 423 has a recession 425.

The metal extruded base 43 is made of copper but not limited thereto. The metal extruded base 43 is substantially in an L shape and has a top 431 and a bottom 432, wherein the top 431 is engaged with the metal conductive piece 44. In some embodiments, the bottom 432 of the metal extruded base 43 has holes 433 to be screwed on the bus bar. The inner surface at the top 431 of the metal extruded base 43 has a concavity 434 extending along the length direction of the metal extruded base 43 to be engaged with the metal conductive piece 44.

The metal conductive piece 44 is made of beryllium copper alloy but not limited thereto; it can also be made of other conductive metals such as phosphor-bronze, brass, stainless steel, and so on. The metal conductive piece 44 has a plurality of resilient bending elements 441 and an engaging portion 442, The engaging portion 442 is engaged with the concavity 434 at the top 431 of the metal extruded base 43, and the resilient bending element 441 is used to contact with the electrically conductive blade of the panel-form connector (not shown).

Figure 5:
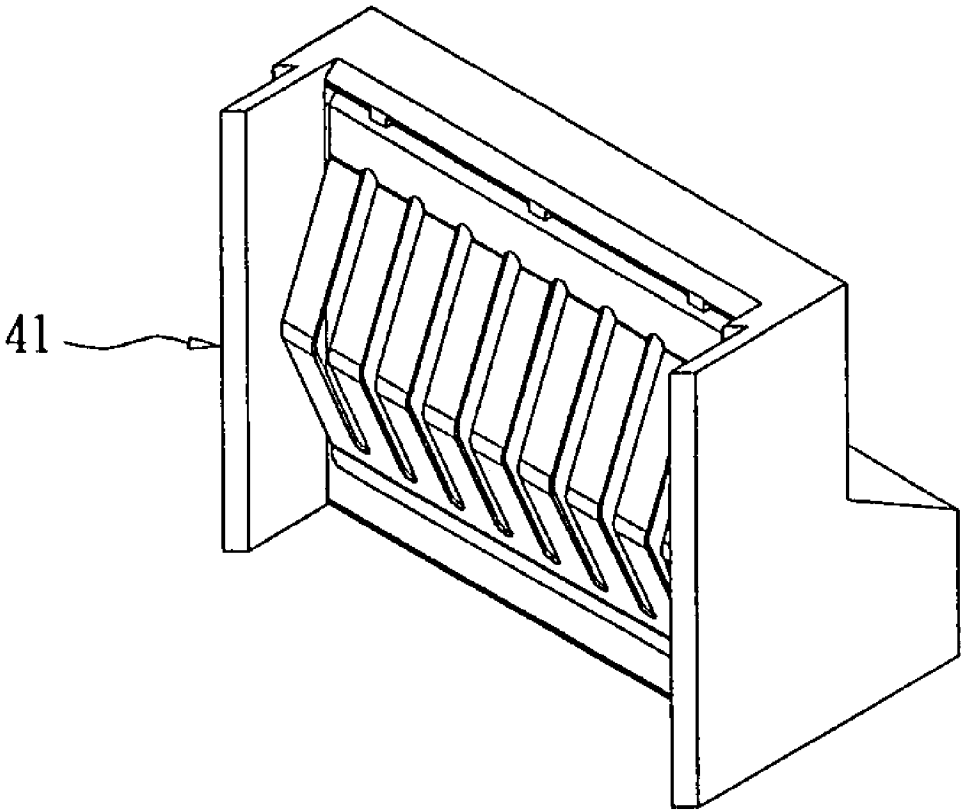
FIG. 5 is a schematic view showing the assembled structure of the conductive device in FIG. 4.

When assembling the aforementioned conductive device 41, the engaging portion 442 of the metal conductive piece 44 is first engaged with the concavity 434 at the top 431 of the metal extruded base 43, and then, the metal extruded base 43 combined with the metal conductive piece 44 are disposed into the groove 424 of the case 42 and fixed inside the case 42. The assembled structure of the conductive device 41 is shown in FIG. 5.

Figure 6:
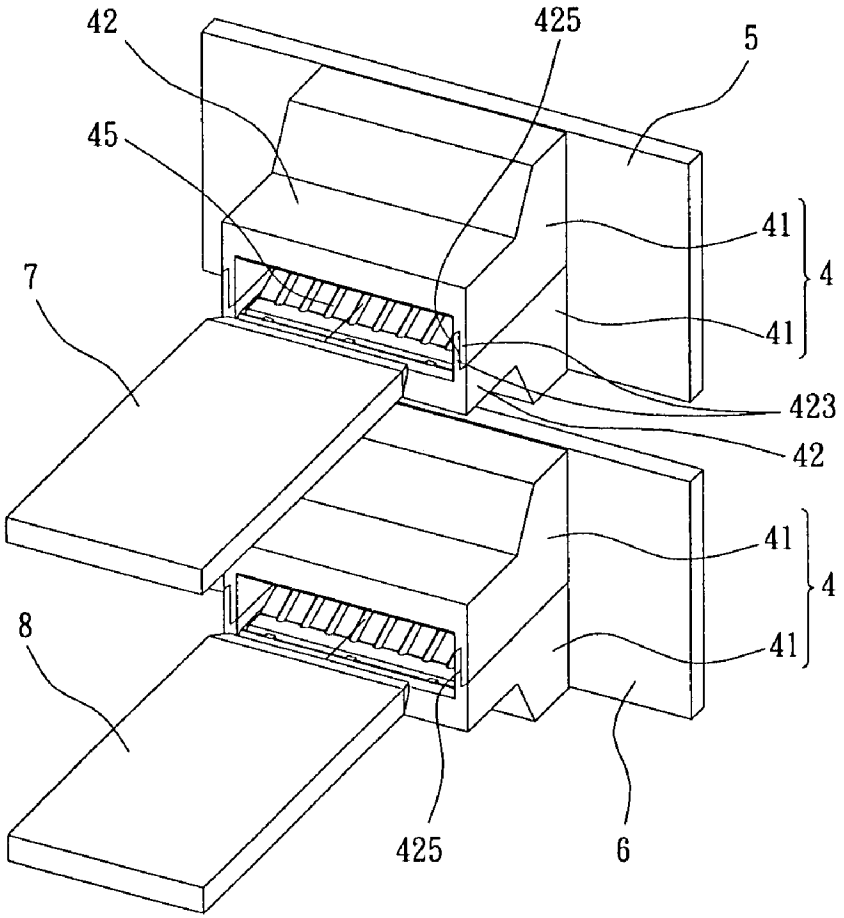
FIG. 6 is a schematic view showing the power connector applied to single-pole connection.

FIG. 6 is a schematic view showing the power connector applied to single-pole connection. As shown in FIG. 6, the two identical power connectors 4 are disposed on the bus bars 5 and 6, wherein the bus bar 5 is for the positive connection and the bus bar 6 is for the negative connection. Each power connector 4 is composed of a pair of the conductive devices 41, wherein the side plates 423 of one conductive device 41 contact with the side plates 423 of the other conductive device 41 at the recessions 425. Through the cooperation of the two cases 42 of the two conductive devices 41, an opening 45 can be formed therebetween. The width of the opening 45 can be adjusted by controlling the relative distance between the two conductive devices 41. The single-pole panel-form connectors 7 and 8 can be inserted into the openings 45 of the power connectors 4 so as to be electrically conducted with the bus bars 5 and 6.

Figure 7:
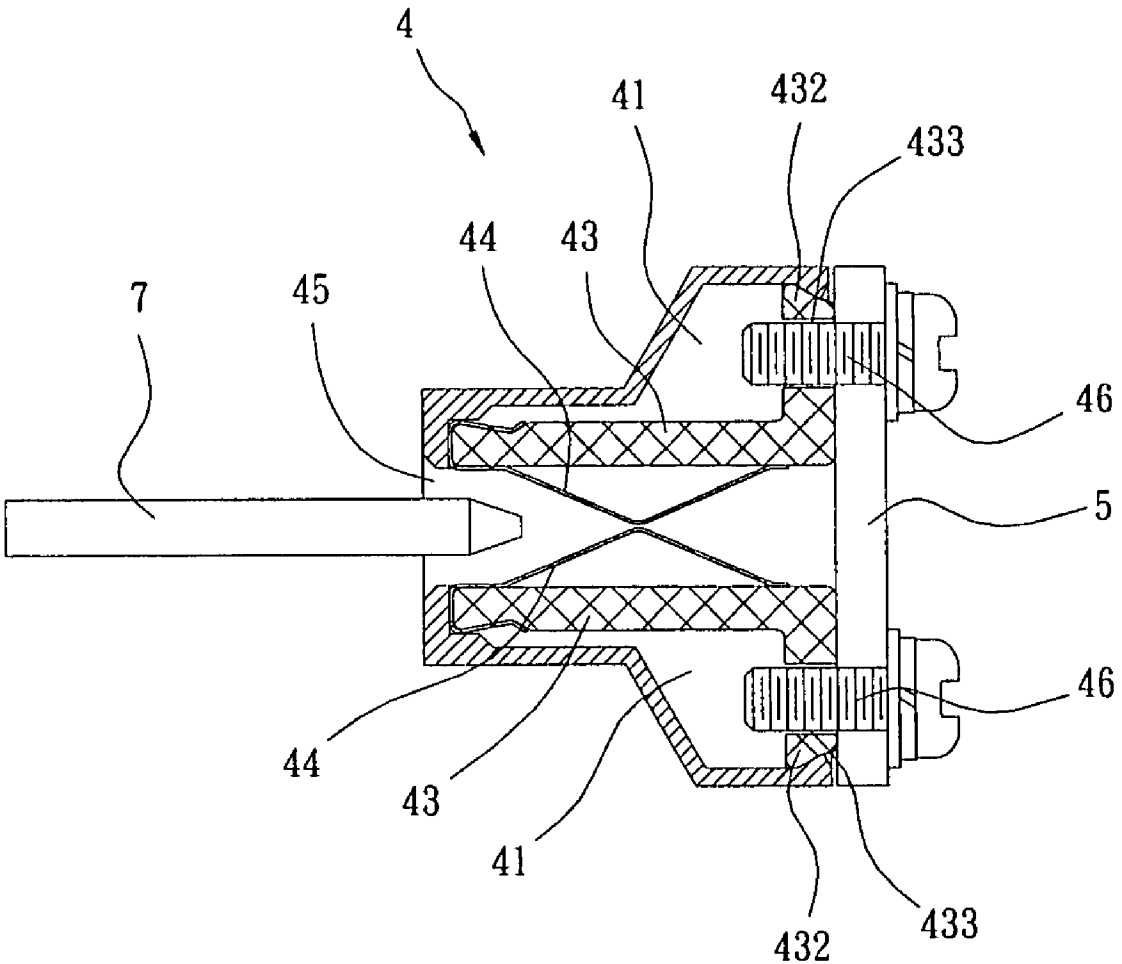
FIG. 7 is a cross-sectional view showing the power connector applied to single-pole connection in FIG. 6.

FIG. 7 is a cross-sectional view showing the power connector applied to single-pole connection in FIG. 6. As shown in FIG. 7, each conductive device 41 of the power connector 4 is fixed on the bus bar 5 by fastening the screw 46 into the hole 433 at the bottom 432 of the metal extruded base 43. When the power connector 4 is applied to single-pole connection, the opening 45 of the power connector 4 can be adjusted by controlling the relative distance between the two conductive devices 41, so that the single-pole panel-form connector 7 can be inserted into the opening 45 of the power connector 4 and contacts with the metal conductive piece 44 to achieve the single-pole connection.

Figure 8:
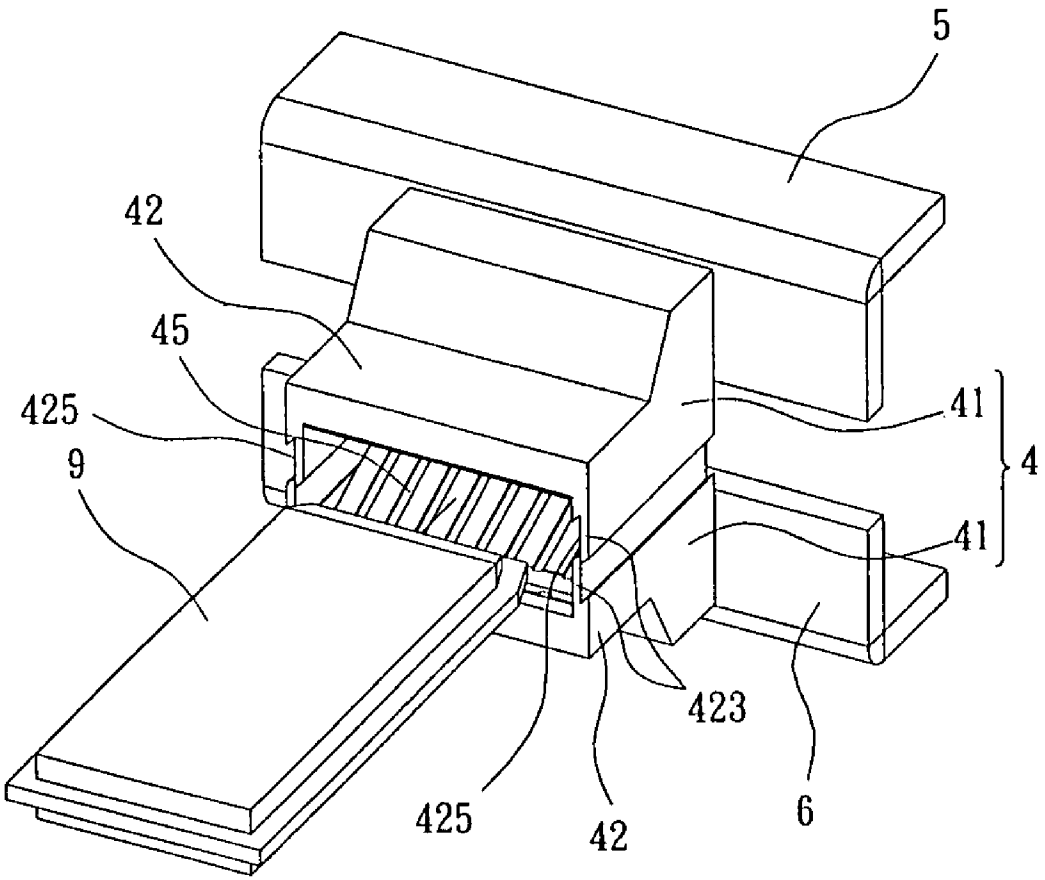
FIG. 8 is a schematic view showing the power connector applied to dual-pole connection.

FIG. 8 is a schematic view showing the power connector applied to dual-pole connection. As shown in FIG. 8, the two conductive devices 41 of the power connector 4 are disposed respectively on the bus bars 5 and 6, wherein the bus bar 5 is for the positive connection and the bus bar 6 is for the negative connection. Similarly, the side plates 423 of one conductive device 41 contact with the side plates 423 of the other conductive device 41 at the recessions 425. Through the cooperation of the two cases 42 of the two conductive devices 41, an opening 45 can be formed therebetween. Since the two conductive devices 41 are disposed respectively on the bus bars 5 and 6, the width of the opening 45 of the power connector 4 in FIG. 8 is wider than that of the opening 45 of the power connector 4 applied to single-pole connection in FIG. 6, so that a dual-pole panel-form connector 9 can be inserted into the opening 45 to be electrically conducted with the bus bars 5 and 6.

Figure 9:
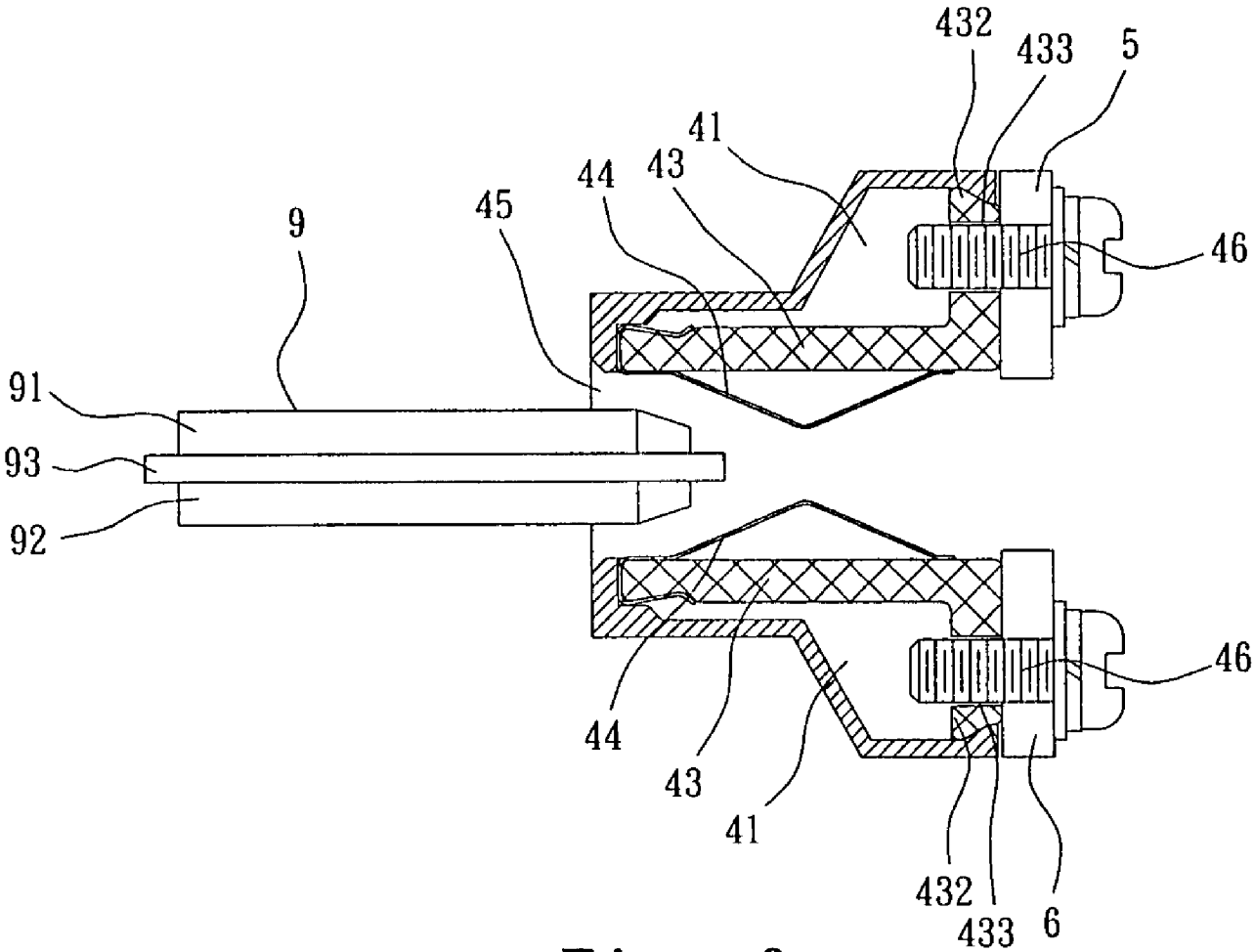
FIG. 9 is a cross-sectional view showing the power connector applied to dual-pole connection in FIG. 8.

FIG. 9 is a cross-sectional view showing the power connector applied to dual-pole connection in FIG. 8. As shown in FIG. 9, each conductive device 41 of the power connector 4 is fixed on the bus bar 5 or 6 by fastening the screw 46 into the hole 433 at the bottom 432 of the metal extruded base 43. When the power connector 4 is applied to dual-pole connection, the opening 45 of the power connector 4 can be adjusted by controlling the relative distance between the two conductive devices 41, so that the panel-form connector 9 with a positive pole and a negative pole can be inserted into the opening 45 of the power connector 4 and contact respectively with the corresponding metal conductive pieces 44 to achieve the dual-pole connection. Since the width of the opening 45 of the power connector 4 can be adjusted flexibly by controlling the relative distance between the two conductive devices 41, the power connector 4 can be used for the panel-form connectors with various thicknesses and structures. For example, the panel-form connector 9 can include a positive plate 91, a negative plate 92, and an isolation plate or a printed circuit board 93, wherein the isolation plate or the printed circuit board 93 is disposed between the positive plate 91 and the negative plate 92. Therefore, the design of the panel-form connector 9 can directly employ the isolation plate or the printed circuit board 93 to isolate the positive plate 91 and the negative plate 92 in accordance with the circuit design.

In conclusion, the present invention provides a power connector composed of two conductive devices. Since the width of the opening of the power connector can be adjusted by controlling the relative distance between the two conductive devices, the power connector can be applied to both single-pole and dual-pole connections, so it can be used more flexibly. Besides, the metal extruded base has a smaller size and a better electrical conductivity, and since it is formed by the extrusion process, the problem of worse electrical conductivity on the bending structure of the conventional power connector can be overcome. Furthermore, the power connector of the present invention owns the advantages of simple structure, easy assembling, and small volume, so it can be applied more conveniently.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power connector to be connected with a panel-form connector, said power connector comprising:

a pair of conductive devices, each said conductive device comprising:

a case;

a metal base; and a metal conductive piece combined with said metal base and disposed into said case;

wherein said cases of said conductive devices are cooperated with each other to define an opening, and the width of said opening is adjustable by controlling the relative distance between said conductive devices for receiving various panel-form connectors with different thicknesses.

2. The power connector according to claim 1, wherein said pair of conductive devices have identical structure, shape and size.

3. The power connector according to claim 1, wherein said metal base is a metal extruded base.

4. The power connector according to claim 3, wherein said metal extruded base is made of copper.

5. The power connector according to claim 3, wherein said metal extruded base is substantially in an L shape and has a top and a bottom, said top being engaged with said metal conductive piece.

6. The power connector according to claim 5, wherein said bottom of said metal extruded base has a hole, and an inner surface of said top has a concavity extending along the length direction of said metal extruded base.

7. The power connector according to claim 1, wherein said case has a top and a bottom, the cross-sectional area of said bottom being bigger than that of said top.

8. The power connector according to claim 7, wherein said case has two side plates respectively extending outward along two sides of said case, thereby forming a groove.

9. The power connector according to claim 8, wherein a side of each side plate has a recession.

10. The power connector according to claim 1, wherein said metal conductive piece is made of beryllium copper alloy.

11. The power connector according to claim 1, wherein said metal conductive piece has a plurality of resilient bending elements used to contact with said panel-form connector and an engaging portion being engaged with said metal base.

12. A power connector disposed on a bus bar and to be connected with a panel-form connector, said power connector comprising:

a pair of conductive devices disposed on said bus bar, each said conductive device comprising:

a case;

a metal base; and a metal conductive piece combined with said metal base and disposed into said case;

wherein said cases of said conductive devices are cooperated with each other to define an opening, and the width of said opening is adjustable by controlling the relative distance between said conductive devices for receiving various panel-form connectors with different thicknesses.

13. The power connector according to claim 12, wherein said panel-form connector is a single-pole panel-form connector.

14. The power connector according to claim 12, wherein said metal base is substantially in an L shape and has a top and a bottom, said top being engaged with said metal conductive piece.

15. The power connector according to claim 14, wherein said bottom of said metal base has a hole to be screwed on said bus bar.

16. The power connector according to claim 12, wherein said metal conductive piece has a plurality of resilient bending elements used to contact with said panel-form connector and an engaging portion being engaged with said metal base.

17. A power connector disposed on two bus bars and to be connected with a panel-form connector, said power connector comprising:

a pair of conductive devices, each said conductive device disposed on one of said two bus bars and comprising:

a case;

a metal base; and a metal conductive piece combined with said metal base and disposed into said case;

wherein said cases of said conductive devices are cooperated with each other to define an opening, and the width of said opening is adjustable by controlling the relative distance between said conductive devices for receiving various panel-form connectors with different thicknesses.

18. The power connector according to claim 17, wherein said panel-form connector is a dual-pole panel-form connector.

19. The power connector according to claim 18, wherein said dual-pole panel-form connector comprises:

a positive plate;

a negative plate; and an isolation plate disposed between said positive plate said negative plate.

20. The power connector according to claim 18, wherein said dual-pole panel-form connector comprises:

a positive plate;

a negative plate; and a printed circuit board disposed between said positive plate said negative plate.

* * * * *